United States Patent [19]

Bauer et al.

[11] Patent Number: 4,799,857

[45] Date of Patent: Jan. 24, 1989

[54] CASING FOR FLUID FLOW MACHINES

[75] Inventors: Gerd H. Bauer, Wattenheim; Armin Görisch, Offstein; Herbert Hartmüller, Ludwigshafen; Gerhard Meyer, Frankenthal; Alexander Nicklas, Dirmstein; Detlef Prokasky, Frankenthal; Jürgen Schill, Weisenheim, all of Fed. Rep. of Germany

[73] Assignee: Klein, Schanzlin & Becker Aktiengesellschaft, Frankenthal/Pflaz, Fed. Rep. of Germany

[21] Appl. No.: 123,380

[22] Filed: Nov. 20, 1987

[30] Foreign Application Priority Data

Nov. 29, 1986 [DE] Fed. Rep. of Germany ..... 3640894

[51] Int. Cl.[4] ..... F04D 29/42

[52] U.S. Cl. ..... 415/185; 415/208; 415/219 C

[58] Field of Search ..... 415/182, 183, 185, 196, 415/206, 208, 219 R

[56] References Cited

U.S. PATENT DOCUMENTS

| | | | |
|---|---|---|---|
| 2,542,902 | 2/1951 | Chubbuck | 415/208 |
| 3,421,446 | 1/1969 | Strscheletzly | 415/208 |
| 3,560,105 | 2/1971 | Clifford | 415/219 C X |
| 3,859,008 | 1/1975 | Wieser | 415/208 X |

FOREIGN PATENT DOCUMENTS

| | | | |
|---|---|---|---|
| 664629 | 8/1938 | Fed. Rep. of Germany | 415/182 |
| 3011888 | 10/1981 | Fed. Rep. of Germany | 415/182 |
| 2008676 | 6/1979 | United Kingdom | 415/219 C |

*Primary Examiner*—Robert E. Garrett
*Assistant Examiner*—Joseph M. Pitko
*Attorney, Agent, or Firm*—Peter K. Kontler

[57] ABSTRACT

A fluid flow machine, particularly a centrifugal pump, wherein the casing has a tubular first portion serving to convey a stream of fluid radially toward a pump shaft which drives one or more impellers. The casing has a second portion with an arcuate band-like wall which spacedly surrounds the shaft and defines a passage having an oval cross-sectional outline and receiving fluid from the outlet of the first portion. A cylindrical outlet of the passage is adjacent the foremost impeller or the only impeller of the pump. One or more guides are provided in the passage to control the flow of fluid from the outlet of the first portion of the casing toward and into the range of the foremost impeller.

10 Claims, 3 Drawing Sheets

CASING FOR FLUID FLOW MACHINES

BACKGROUND OF THE INVENTION

The invention relates to improvements in fluid flow machines, and more particularly to improvements in casings for fluid flow machines such as single-stage or multi-stage centrifugal pumps. Still more particularly, the invention relates to improvements in fluid flow machines of the type wherein the casing includes a first portion or section serving to convey a stream of fluid substantially at right angles to the axis of the shaft which drives one or more fluid conveying elements or which receives torque from one or more fluid conveying elements.

Many types of fluid flow machines are provided with casings wherein a first portion constitutes or resembles a tube serving to direct a stream of fluid radially inwardly toward the axis of the shaft and the outlet of such first portion admits the fluid into a passage which surrounds the shaft and serves to direct the admitted fluid into the range of the foremost impeller if the machine is a multi-stage pump. Thus, the direction of fluid flow is changed through an angle of approximately 90 degrees because the fluid is supplied radially inwardly toward the shaft and is then caused to flow in parallelism with the shaft. Such pronounced change of the direction of fluid flow often results in the development of a highly unpredictable stream in the region immediately ahead of the foremost fluid conveying element on the shaft. The stream is likely to cause cavitation which entails damage to the foremost fluid conveying element and thus reduces the life span of the affected element.

German Auslegeschrift No. 21 58 518 discloses a multi-stage centrifugal pump. FIGS. 6 and 7 of this publication show two forms of a casing with an inlet portion and a portion which defines a passage for the flow of fluid from the inlet portion to the foremost impeller. The pump casing is formed with an internal surface having a U-shaped or crescent-shaped outline. The casing is also formed with three or four bores which convey fluid from a location ahead of the outlet of the radially extending inlet portion so as to direct streamlets of fluid directly into the annular passage around the shaft along the full width of the internal surface, as seen in the axial direction of the shaft. The numerous streamlets which are diverted from the main stream of inflowing fluid produce extensive turbulence in the body of fluid filling the passage with the well known undesirable effects upon the performance and useful life of the impellers.

OBJECTS AND SUMMARY OF THE INVENTION

An object of the invention is to provide a fluid flow machine, such as a single-stage or multistage centrifugal pump, with a novel and improved casing which is designed in such a way that it reduces or eliminates turbulence in the stream which approaches the fluid conveying element or elements on the shaft, which can be produced at a reasonable cost and which is less likely to cause cavitation than heretofore known casings wherein the first portion is designed to direct the inflowing fluid radially of the shaft.

Another object of the invention is to provide a centrifugal pump which embodies the above outlined casing.

A further object of the invention is to provide a fluid flow machine wherein the casing portion which causes the fluid to change the direction of its flow from a direction radially of the axis of the shaft to a direction in parallelism with the axis of the shaft is constructed and assembled in a novel and improved way.

An additional object of the invention is to provide a casing which can be used with advantage in all or nearly all types of fluid flow machines wherein a portion of the casing causes the fluid to flow substantially radially of the shaft which forms part of the rotor and carries one or more fluid conveying elements in the form of impellers or the like.

Still another object of the invention is to provide a novel and improved method of assembling the casing of a fluid flow machine wherein one portion of the casing conveys the fluid radially of the shaft.

The invention is embodied in a fluid flow machine, particularly in a centrifugal pump, which comprises a rotor having a shaft rotatable about a predetermined axis and at least one fluid conveying element on the shaft. The machine further comprises a casing having a fluid-admitting (preferably or substantially tubular) first portion which extends substantially radially of the shaft and has a first outlet, and a second portion which is rigid with the first portion and includes a substantially band-like arcuate wall which spacedly surrounds the shaft and defines with the shaft a passage for reception of fluid from the first outlet. The wall has end portions which flank the first outlet, and the passage has a substantially (e.g., largely) oval cross-sectional outline in a plane which extends at right angles to the axis of the shaft. The second portion of the casing has a second outlet (e.g., a circular outlet) which receives fluid from the passage and is adjacent the at least one fluid conveying element of the rotor means.

The casing further comprises a third portion which surrounds the fluid conveying element (the latter can constitute the first or the only impeller of a multi-stage or single-stage centrifugal pump). That end of the arcuate wall which is remote from the second outlet can be rigid or integral with an end wall which forms part of the second portion of the casing and seals the respective end of the arcuate wall.

The end portions of the arcuate wall preferably make an angle of at least 10 degrees and diverge in a direction from the first outlet toward the shaft. The concave internal surface of the arcuate wall can have its center of curvature on or close to the axis of the shaft, e.g., such center of curvature can be located between the axis and the first outlet. At least one radius of curvature (R2) of the concave internal surface of the arcuate wall can equal 1.2–1.8 R1 (wherein R1 is the radius of the second outlet). The width of the first outlet in the axial direction of the shaft at most equals the width of the arcuate wall.

At least one guide can be provided in the passage to control the flow of fluid from the first outlet toward the second outlet. Such guide can be disposed in the region of the second outlet and can be provided on the arcuate wall and/or on the third portion of the casing.

The second portion of the casing can comprise an outer wall which spacedly surrounds the arcuate wall.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
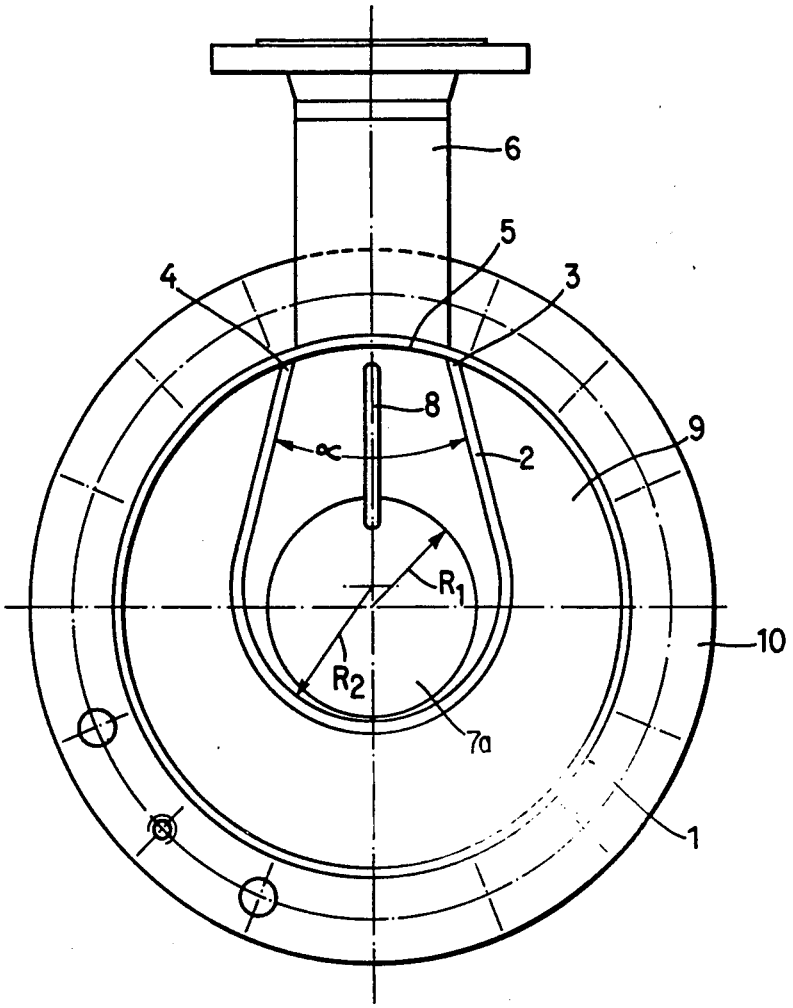
FIG. 1 is a transverse sectional view of a fluid flow machine which embodies one form of the invention, the section being taken in the direction of arrows as seen from the line I—I of FIG. 2.
Figure 2:
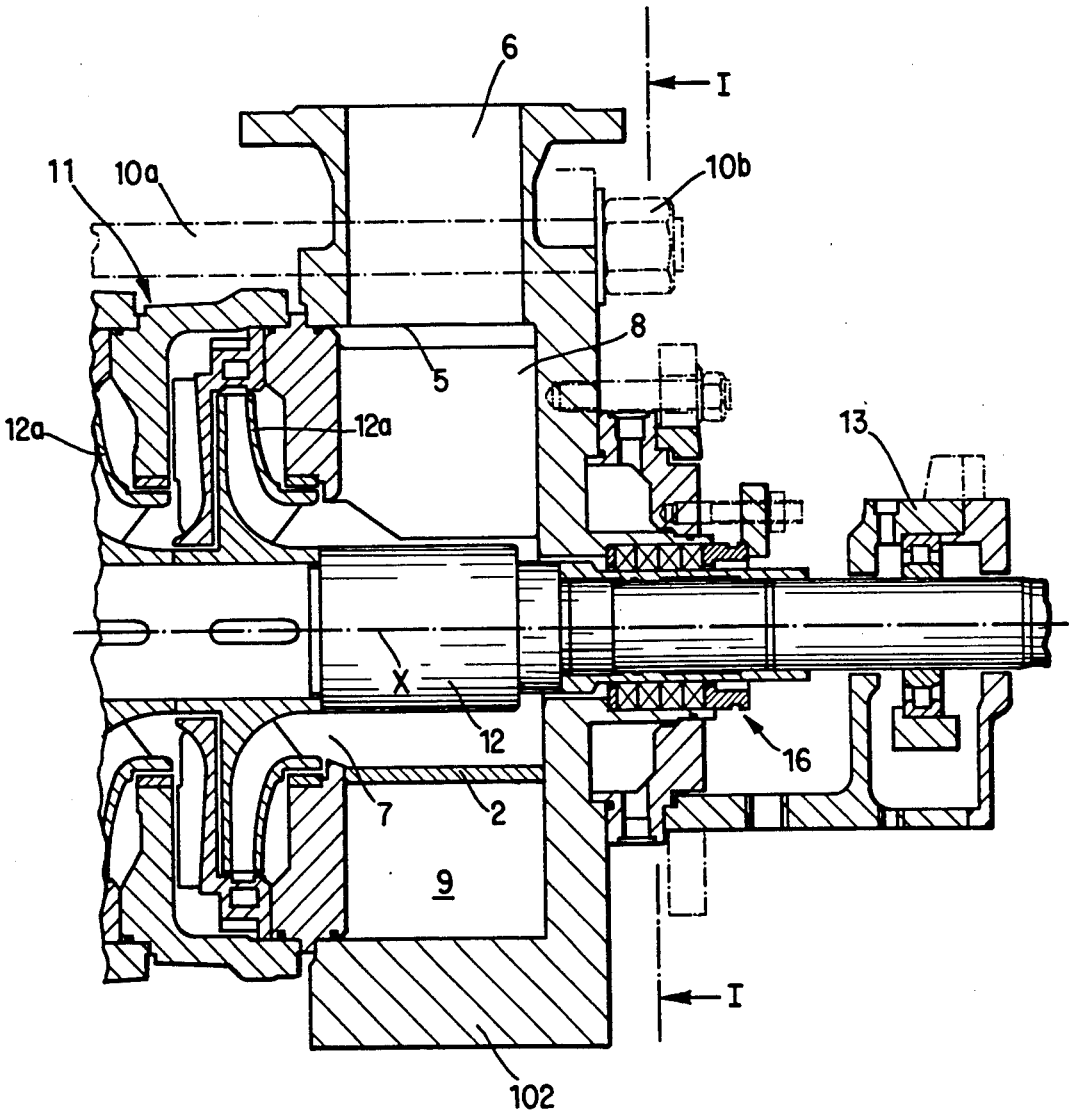
FIG. 2 is a fragmentary axial sectional view of the machine which is shown in FIG. 1.

The fluid flow machine which is shown in FIGS. 1 and 2 is a multi-stage centrifugal pump having a rotor including a shaft 12 and a series of fluid conveying elements 12*a* in the form of impellers which are rotated by the shaft. The casing 1 of the pump includes a tubular first portion 6 which extends radially of the axis X of the shaft 12 and has an outlet 5 serving to admit a fluid (e.g., a liquid) into a passage 7 which surrounds the shaft 12 and is, in turn, surrounded by a band- or web-like arcuate wall 2 forming part of a second portion of the casing 1. The passage 7 within the arcuate wall 2 has a substantially oval cross-sectional outline in a plane which is normal to the axis X, and those end portions (3 and 4) of the wall 2 which flank the outlet 5 of the first casing portion 6 diverge at an angle alpha of at least 10 degrees in a direction from the outlet 5 toward the shaft 12. The second portion of the casing 1 further includes a second or outer wall 102 which spacedly surrounds the wall 2 and defines therewith an arcuate chamber 9. The outlet 7*a* of the passage 7 within the arcuate wall 2 is adjacent the foremost impeller 12*a* on the pump shaft 12. The end portions 3, 4 of the arcuate wall 2 are welded or otherwise sealingly secured to the outer wall 102. The wall 2 compels the entire stream of fluid which is supplied by the tubular portion 6 to enter the passage 7 and to flow through the outlet 7*a* of the second portion of the casing 1 and into the range of the first impeller 12*a*. The dimensions of the passage 7 within the wall 2 (as measured at right angles to the shaft 12) increase in a direction from the outlet 5 toward the axis X and thereupon decrease gradually because the portion of the wall 2 which surrounds the shaft 12 has a concave internal surface with at least one radius of curvature R2 which is at least slightly greater than the radius (R1) of the cylindrical outlet 7*a* of the passage 7 immediately upstream of the first impeller 12*a*. It is presently preferred to select the radius R2 in such a way that it is not less than 1.2 R1 and not more than 1.8 R1.

A guide means 8 in the form of a plate or blade of sheet metal or the like is provided in the passage 7 to control the flow of fluid between the outlet 5 of the casing portion 6 and the outlet 7*a* of the passage 7. The illustrated guide means 8 is installed in the passage 7 between the outlet 5 and the shaft 12 and is disposed in a plane which includes the axis X. FIG. 1 shows that the center of curvature of the concave internal surface of the wall 2 is disposed in the plane of the guide means 8 between the axis X and the outlet 5. However, it is equally within the purview of the invention to select the curvature of the internal surface of the wall 2 in such a way that the center of curvature of this internal surface is located on the axis X of the shaft 12.

The outer wall 102 of the second portion of the casing 1 is preferably a ring-shaped body which can be mass-produced at a reasonable cost and which defines a bore or hole for reception of the arcuate wall 2 in a manner as shown in FIG. 1. Instead of being welded to the wall 102, the end portions 3 and 4 of the arcuate wall 2 can be sealingly secured to the outer wall 102 by screws or in any other suitable way. The magnitude of the angle alpha is selected with a view to ensure a predictable flow of fluid from the outlet 5 into and in the passage 7. A flange 10 of the outer wall 102 is connected to a simpler flange (not shown) at the other end of the casing 1 by a set of axially parallel bolts 10*a* and nuts 10*b* (indicated by phantom lines). The two flanges maintain the shells of individual stages 11 of the pump in proper sealing engagement with each other.

It has been found that the flow of fluid from the casing portion 6 into the first stage 11 (third portion of the casing 1) of the fluid flow machine is highly satisfactory, particularly because it is free of turbulence such as could cause cavitation in the region of the first impeller 12*a*. Auxiliary guide means (see FIG. 3) can be provided in the passage 7 in the region of the outlet 7*a* of this passage to control the flow in addition to or in lieu of the guide means 8. Such auxiliary guide means can be provided on the shell of the first stage 11 and/or on the arcuate wall 2.

That portion of the shaft 12 which extends beyond the passage 7 is surrounded by a stuffing box 16 or by an analogous sealing device and is rotatable in a suitable bearing 13.

The arcuate wall 2 can constitute a suitably bent strip or web of metallic material. The dimensions of such web or band are selected with a view to optimize the flow of fluid from the outlet 5 of the first portion 6 of the casing 1 toward and into the normally cylindrical outlet 7*a* immediately ahead of the first impeller 12*a*.

It has been found that the aforediscussed mutual inclination of end portions 3, 4 of the arcuate wall 2 at an angle of 10 degrees or more ensures a highly satisfactory flow of fluid from the first portion 6 of the casing 1 into the passage 7, i.e, such design of the wall 2 ensures a highly satisfactory transition from a direction of flow radially of the shaft 12 to a direction of flow in substantial parallelism with the axis X. The just discussed configuration of the wall 2 ensures that the flow of fluid in the passage 7 and on toward the foremost impeller 12*a* is practically free of turbulence.

The aforediscussed selection of the radius of curvature R2 ensures a highly satisfactory flow of fluid in the region where the fluid reaches the shaft 12 and is compelled to flow in parallelism with the axis X. Experiments indicate that, if the radius R2 is between 1.2 R1 and 1.8 R2, the likelihood of cavitation in the region of the foremost impeller 12*a* is very remote.

The width of the arcuate wall 2 in the axial direction of the shaft 12 preferably equals or exceeds the width of the outlet 5. Thus, if the outlet 5 is circular, the width of the wall 2 in the axial direction of the shaft 12 at least matches the diameter of the outlet 5. It is often desirable and advantageous to enlarge the outlet 5 in a direction toward the shaft 12 and to impart to the surface surrounding the outlet 5 a streamlined shape. This even further reduces the likelihood of turbulence at the outlet 5 because such configuration of the surface bounding the outlet 5 promotes the separation of conveyed fluid from the portion 6 of the casing 1.

The provision of guide means (such as 8) in the passage 7 is desirable and advantageous but not essential. As a rule, guide means (such as one or more plate-like parts corresponding to that shown at 8) will be employed in relatively large casings or whenever the casing is to convey a large quantity of fluid per unit of time.

Figure 3:
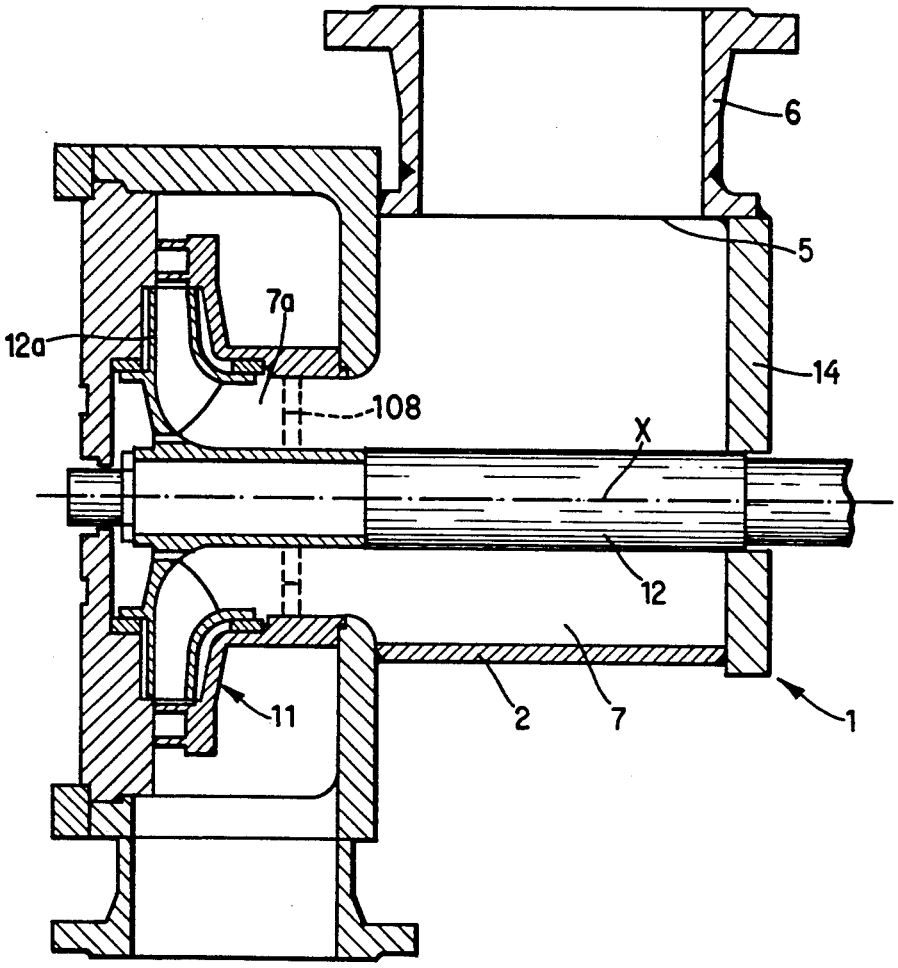
FIG. 3 is a fragmentary axial sectional view of a modified machine.

FIG. 3 shows a portion of a single-stage centrifugal pump wherein the outer wall 102 is omitted and that end of the arcuate wall 2 which is remote from the outlet *7a* of the passage 7 is sealed by an end wall 14 forming part of the second portion of the casing 1 and being further welded to the first portion 6 whose outlet 5 admits fluid into the passage 7. The outlet *7a* of the passage 7 admits fluid into the range of the single impeller 12*a* on the shaft 12. An auxiliary guide means 108 is installed in the outlet *7a* to control the flow of fluid in the region of the impeller 12*a*. Such auxiliary guide means 108 can be used in lieu of or in addition to the guide means 8 of FIGS. 1 and 2 and can be welded to the shell of the single stage 11 or to the wall 7.

The auxiliary guide means 108 in the region of the outlet *7a* of the passage 7 can include one or more rings or otherwise configurated bodies which assist the supplied fluid in changing the direction of flow from a direction of parallelism with the axes X of the shaft 12 to a direction circumferentially of the shaft, i.e., in the direction of rotation of the impeller 12*a*.

It is clear that the second portion of the pump casing 1 of FIGS. 1 and 2 can also operate without the outer wall 102, i.e., the second portion of the casing 1 can consist essentially of the arcuate wall 2 and an end wall corresponding to the end wall 14 of FIG. 3.

The bearing or bearings (not specifically shown) for the shaft 12 can be provided in or on the end wall 14.

An advantage of the machine of FIG. 3 is that its casing 1 is very simple and can be produced at a reasonable cost. The tubular first portion 6 of the casing 1 of FIG. 3 is welded directly to the two end portions of the arcuate wall 2 and to the adjacent portion of the end wall 14. The left-hand end of the wall 2 is welded to the shell of the single stage 11 of the illustrated machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a fluid flow machine, particularly in a centrifugal pump, a rotor including a shaft arranged to rotate about a predetermined axis; and a casing having a fluid-admitting first portion extending substantially radially of said shaft and having a first outlet, and a second portion rigid with said first portion and comprising a substantially band-like arcuate wall spacedly surrounding said shaft and defining therewith a passage for reception of fluid from said first outlet, said wall having end portions flanking said first outlet and said passage having a substantially oval cross-sectional outline in a plane extending at right angles to said axis, said second portion having a second outlet arranged to receive fluid from said passage and said rotor means further comprising at least one fluid conveying element provided on said shaft, adjacent said second outlet and arranged to convey liquid away from said wall.

2. The structure of claim 1, wherein said casing further comprises a third portion rigid with said second portion and surrounding said at least one fluid conveying element, said arcuate wall having an end remote from said second outlet and said second portion further comprising an end wall sealingly secured to the end of said arcuate wall.

3. The structure of claim 1, wherein the end portions of said wall make an angle of at least 10 degrees and diverge in a direction from said first outlet toward said axis.

4. The structure of claim 1, wherein said wall has a concave internal surface with a center of curvature on or close to said axis.

5. The structure of claim 4, wherein said center of curvature is located between said first outlet and said axis.

6. The structure of claim 1, wherein said wall has a concave internal surface with a radius of curvature (R2) which equals 1.2–1.8 R1 wherein R1 is the radius of said second outlet.

7. The structure of claim 1, wherein said first outlet has a predetermined width in the axial direction of said shaft and said wall has a width which at least matches said predetermined width.

8. The structure of claim 1, further comprising at least one guide for the flow of fluid from the first to the second outlet.

9. The structure of claim 1, wherein the second portion of said casing further comprises a second wall spacedly surrounding said arcuate wall.

10. The structure of claim 1, further comprising guide means for the flow of fluid in said passage in the region of said second outlet.

* * * * *